US006184634B1

(12) United States Patent
Ossmann et al.

(10) Patent No.: US 6,184,634 B1
(45) Date of Patent: Feb. 6, 2001

(54) CIRCUIT ARRANGEMENT FOR IGNITING AND OPERATING A LAMP HAVING PIEZOELECTRIC TRANSFORMER

(75) Inventors: Martin Ossmann, Aachen; Dieter Leers, Stolberg, both of (DE)

(73) Assignee: U.S. Philips Corporation, New York, NY (US)

( * ) Notice: Under 35 U.S.C. 154(b), the term of this patent shall be extended for 0 days.

(21) Appl. No.: 09/534,215

(22) Filed: Mar. 24, 2000

(30) Foreign Application Priority Data

Mar. 25, 1999 (EP) ..... 99200923

(51) Int. Cl.[7] ..... H05B 37/00
(52) U.S. Cl. ..... 315/276; 315/224; 315/DIG. 5
(58) Field of Search ..... 315/279, 307, 315/291, 276, 277, DIG. 5, 224

(56) References Cited

U.S. PATENT DOCUMENTS 6,091,209 * 7/2000 Hilgers ..... 315/291

FOREIGN PATENT DOCUMENTS

0665600A1 8/1995 (EP) .

* cited by examiner

*Primary Examiner*—David Vu
(74) *Attorney, Agent, or Firm*—Robert J. Kraus

(57) ABSTRACT

A circuit arrangement for supplying a lamp comprises a piezotransformer. During stationary operation the lamp is supplied via the piezotransformer. During ignition a DC-ignition voltage is generated over the secondary side of the piezotransformer acting as capacitor.

4 Claims, 1 Drawing Sheet

CIRCUIT ARRANGEMENT FOR IGNITING AND OPERATING A LAMP HAVING PIEZOELECTRIC TRANSFORMER

BACKGROUND OF THE INVENTION

The invention relates to a circuit arrangement for igniting and operating a lamp, comprising supply terminals for connection to a supply voltage source, a piezotransformer equipped with two input terminals and two output terminals, an oscillator, coupled with the supply terminals and the input terminals of the piezotransformer, for generating a periodical voltage, a load circuit equipped with terminals for lamp connection and coupled between the output terminals of the piezotransformer.

Such a circuit arrangement is known from EP 0665600. The piezotransformer is only very small, so that the known circuit arrangement is very suitable for use in for instance a flat panel display. In the known circuit arrangement both the ignition voltage as well as the voltage present over the lamp during stationary operation are both generated by the piezotransformer. In practice this means that the circuit arrangement can only be used in combination with lamps that have a relatively low ingnition voltage while a relatively high voltage is present over the lamp during stationary operation. The possible applications of the known circuit arrangement are therefore limited. In practice only low pressure discharge lamps can be ignited and operated by means of the known circuit arrangement. High pressure discharge lamps, however, are characterized by a very high ignition voltage while the voltage that is present over the lamp during stationary operation is relatively low. Circuit arrangements for igniting and operating high pressure discharge lamps are typically equipped with either a series- or a parallel igniter for generating an ignition pulse with a relatively high voltage. These igniters tend to be bulky, increasing the size and the cost of the circuit arrangement In case of a series igniter the igniter is arranged in series with the lamp, so that at least part of the series igniter carries a current not only during ignition but also after ignition of the lamp during stationary operation, which leads to power dissipation and therefore a relatively low efficiency of the circuit arrangement. On the other hand, in case use is made of a parallel igniter (arranged in parallel with the lamp), part of the circuit arrangement needs to be protected against the ignition pulse by means of a filter. This filter, however, not only functions during ignition but also carries a current during stationary operation and therefore decreases the efficiency of the circuit arrangement.

SUMMARY OF THE INVENTION

The invention aims to provide a circuit arrangement for igniting and operating a lamp that comprises a piezotransformer and can therefore be relatively small and simple and that additionally is capable of operating lamps having an ignition voltage that differs substantially from the voltage present over the lamp during stationary operation, while the circuit arrangement also does not contain bulky components that dissipate power during stationary operation.

A circuit arrangement as mentioned in the opening paragraph is therefore in accordance with the invention characterized in that the circuit arrangement further comprises an igniter, coupled between the output terminals of the piezotransformer, for generating during ignition a DC voltage with an amplitude that is higher than the voltage that is present between the output terminals of the piezotransformer during stationary lamp operation.

During ignition the secondary side of the piezotransformer functions as a capacitor that is charged by the igniter to a DC voltage with an amplitude that is higher than the voltage that is present between the output terminals of the piezotransformer during stationary lamp operation. The lamp connected to the circuit arrangement is ignited by means of this DC voltage. After the ignition of the lamp the igniter is disabled and the stationary operation of the lamp is started. During this stationary operation a periodical voltage is generated by the oscillator and amplified by the piezotransformer. The amplified periodical voltage is present over the load circuit coupled between the output terminals the piezotransformer. Since the lamp is ignited by means of a DC voltage, the igniter can be of a relatively simple construction and need not comprise parts that dissipate a relatively large amount of power during stationary operation. Furthermore the circuit arrangement needs not comprise a filter. A circuit arrangement according to the invention can be relatively small, can operate with a high efficiency and is capable of igniting and operating lamps that have a relatively high ignition voltage while the voltage present over the lamp during stationary operation is much smaller.

Good results have been obtained for embodiments of a circuit arrangement according to the invention in which the igniter comprises a voltage multiplier. Preferably the oscillator and the piezotransformer can be part of the igniter.

Good results have also been obtained for embodiments of a circuit arrangement according to the invention, wherein the piezotransformer is of the Rosen type.

BRIEF DESCRIPTION OF THE DRAWING

An embodiment of the present invention will be illustrated with reference to a drawing.

In the drawing

DETAILED DESCRIPTION OF THE INVENTION

Figure 1:
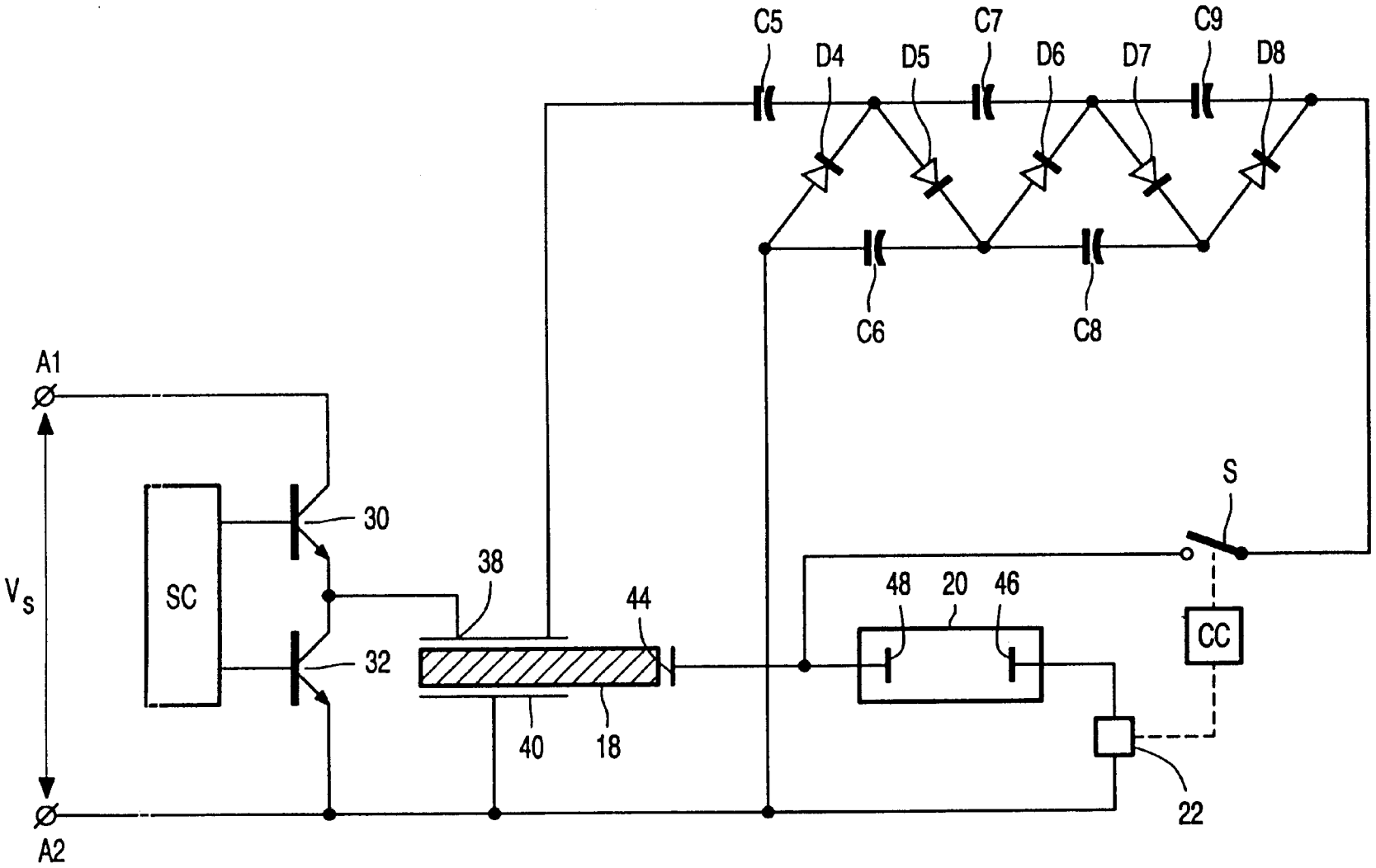
FIG. 1 shows a schematic representation of an embodiment of a circuit arrangement according to the invention together with a connected discharge lamp.

In FIG. 1 A1 and A2 are supply terminals for connection to a supply voltage source. For this embodiment the supply voltage source needs to be a DC voltage source. Supply terminals A1 and A2 are connected by means of a series arrangement of two switching elements 30 and 32. In this embodiment the switching elements are bipolar transistors. SC is a control circuit for rendering the switching elements 30 and 32 alternately conductive and non-conductive. Respective output terminals of control circuit SC are connected to the base electrodes of switching element 30 and switching element 32 respectively. Switching elements 30 and 32 and control circuit SC together form an oscillator for generating a periodical voltage, that during operation is present at a common terminal of the switching elements 30 and 32. 18 is a piezotransformer of the Rosen type. 38 and 40 are electrodes of the piezotransformer that fulfil the function of input terminals. Electrode 40 also functions as a first output terminal of the piezotransformer. A second output terminal of the piezotransformer is formed by electrode 44 of the piezotransformer. A common terminal of switching elements 30 and 32 is connected to input terminal 38 of the piezotransformer. Input terminal 40 of the piezotransformer is connected to supply terminal A2. The input terminals 38 and 40 of the piezotransformer are also connected to respective input terminals of a voltage multiplier that is formed by capacitors C5–C9 and diodes D4–D8. The oscillator and the voltage multiplier together form an igniter. An output terminal of the voltage multiplier is coupled to electrode 44 via a switch S. CC is a control circuit for controlling the conductive state of switch S. To this end an output terminal of control circuit CC is coupled to switch S. This coupling is represented by means of a dotted line. The output terminals 44 and 40 of the piezotransformer are connected by means of a series arrangement of terminal 48 for lamp connection, lamp 20, terminal 46 for lamp connection and ohmic resistor 22. During operation ohmic resistor 22 functions as a sensor and is coupled to an input terminal of control circuit CC. This coupling is represented by means of a dotted line.

The operation of the circuit arrangement shown in FIG. 1 is as follows.

In case a supply voltage source is connected to the supply terminals A1 and A2, control circuit SC alternately renders the switching elements 30 and 32 conductive and non-conductive with a frequency f. As a result a periodical voltage with a frequency f is present between the input terminals 38 and 40 of the piezotransformer 18. The piezotransformer amplifies this periodical voltage. Since the input terminals are also connected to respective input terminals of the voltage multiplier, the voltage multiplier generates a DC-voltage with an amplitude that approximately equals the maximum amplitude of the periodical voltage multiplied by the multiplying factor of the voltage multiplier. Immediately after the circuit arrangement has been rendered operative, the lamp 20 and therefore also the sensor 22 are not conducting a current. As a result the voltage over the sensor is zero and in response to that the control circuit CC renders the switch S conductive. As a result, the sum of the DC-voltage generated by the voltage multiplier and the amplified periodic voltage generated by the piezotransformer is present between the output terminals of the piezotransformer. The secondary side of the piezotransformer functions as a capacitor over which this voltage is present. The lamp 20 is ignited by this voltage. Upon ignition both the lamp 20 and the ohmic resistor 22 carry a current so that a voltage is present over ohmic resistor 22. In response thereto control circuit CC renders switch S non-conductive so that the DC-voltage generated by the voltage multiplier is no longer present between the output terminals of the piezotransformer. After switch S has become non-conductive, however, the amplified periodic signal is present between these output terminals and supplies the lamp 20 during stationary operation.

It is remarked that in case of embodiments in which the DC voltage is generated without making use of the oscillator, the oscillator can remain inactive until after ignition of the lamp. In this case only the DC-voltage generated by the igniter is present between the output terminals of the piezotransformer during ignition.

What is claimed is:

1. Circuit arrangement for igniting and operating a lamp, comprising supply terminals for connection to a supply voltage source, a piezotransformer equipped with two input terminals and two output terminals, an oscillator, coupled with the supply terminals and the input terminals of the piezotransformer, for generating a periodical voltage, a load circuit equipped with terminals for lamp connection and coupled between the output terminals of the piezotransformer, characterized in that the circuit arrangement further comprises an igniter, coupled between the output terminals of the piezotransformer, for generating during ignition a DC voltage with an amplitude that is higher than the voltage that is present between the output terminals of the piezotransformer during stationary lamp operation.

2. Circuit arrangement according to claim 1, wherein the igniter comprises a voltage multiplier.

3. Circuit arrangement according to claim 1, wherein the oscillator and the piezotransformer are part of the igniter.

4. Circuit arrangement according to claim 1, wherein the transformer is a Rosen piezotransformer.

* * * * *